United States Patent [19]

Ricketts

[11] 4,435,017

[45] Mar. 6, 1984

[54] IN SITU OIL SHALE RETORT WITH DIFFERING UPPER AND LOWER VOID FRACTIONS

[75] Inventor: Thomas E. Ricketts, Grand Junction, Colo.

[73] Assignee: Occidental Oil Shale, Inc., Grand Junction, Colo.

[21] Appl. No.: 310,441

[22] Filed: Oct. 13, 1981

Related U.S. Application Data

[62] Division of Ser. No. 133,409, Mar. 24, 1980, Pat. No. 4,326,752.

[51] Int. Cl.[3] ..... E21C 41/10

[52] U.S. Cl. ..... 299/19

[58] Field of Search ..... 299/2, 19; 166/259

[56] References Cited

U.S. PATENT DOCUMENTS

| | | | |
|---|---|---|---|
| 3,980,339 | 9/1976 | Heald et al. | 299/2 |
| 4,043,597 | 8/1977 | French | 299/2 |
| 4,047,760 | 9/1977 | Ridley | 299/2 |
| 4,146,272 | 3/1979 | French | 299/2 |
| 4,149,595 | 4/1979 | Cha | 166/259 |
| 4,239,284 | 12/1980 | Ridley et al. | 299/2 |

*Primary Examiner*—Ernest R. Purser

*Attorney, Agent, or Firm*—Christie, Parker & Hale

[57] ABSTRACT

An in situ oil shale retort is formed in a subterranean formation by excavating voids adjacent the top and bottom boundaries of the retort, leaving an intermediate zone of unfragmented formation between the voids. The lower level void is substantially larger than the upper level void. A lower portion of the intermediate zone is explosively expanded downwardly towards the lower level void for forming a first moiety of a fragmented mass of formation particles in the retort and leaving a void space over the top of the first moiety having about the same volume as the upper level void. Thereafter an upper portion of the intermediate zone is explosively expanded upwardly towards the upper level void and downwardly towards the void space for forming a second moiety of the fragmented mass in the retort. The fragmented mass has an average void fraction up to about 25% and no substantial part has a void fraction less than about 20%.

4 Claims, 4 Drawing Figures

IN SITU OIL SHALE RETORT WITH DIFFERING UPPER AND LOWER VOID FRACTIONS

This is a division of application Ser. No. 133,409, filed Mar. 24, 1980, U.S. Pat. No. 4,326,752.

BACKGROUND

This invention relates to in situ recovery of shale oil and more particularly to a technique for forming an in situ oil shale retort in a subterranean formation, the retort containing a fragmented permeable mass of formation particles having a reasonably uniformly distributed void fraction.

The presence of large deposits of oil shale in the Rocky Mountain region of the United States has given rise to extensive efforts to develop methods for recovering shale oil from kerogen in the oil shale deposits. The term "oil shale" as used in the industry is, in fact, a misnomer, it is neither shale nor does it contain oil. It is a sedimentary formation comprising marlstone deposit containing an organic material called kerogen which, upon heating, decomposes to produce liquid and gaseous products. It is the formation containing kerogen that is called "oil shale" herein and the carbonaceous liquid product is called "shale oil".

A number of methods have been proposed for processing oil shale which involve either first mining the oil shale and processing it on the ground surface or processing the oil shale in situ. The latter approach is preferable from the standpoint of environmental impact since the treated oil shale remains in place reducing the chance of surface contamination and the requirement for disposal of solid wastes.

The recovery of liquid and gaseous products from oil shale deposits has been described in several patents, such as U.S. Pat. Nos. 3,661,423; 4,043,597; and 4,043,598, which are incorporated herein by this reference. These patents describe in situ recovery of liquid and gaseous products from a subterranean formation containing oil shale wherein such formation is explosively expanded for forming a fragmented permeable mass of formation particles containing oil shale within the subterranean formation, referred to herein as an in situ oil shale retort. Hot retorting gases are passed through the fragmented mass in the retort for converting kerogen contained in the oil shale to liquid and gaseous products.

One method of supplying hot retorting gases used for converting kerogen contained in the oil shale as described in U.S. Pat. No. 3,661,423, includes establishment of a combustion zone in the retort and introduction of an oxygen-supplying inlet mixture for advancing the combustion zone through the fragmented mass. In the combustion zone oxygen in the mixture is depleted by reaction with hot carbonaceous materials to produce heat, combustion gas, and spent oil shale. By the continued introduction of such a mixture into the retort the combustion zone is advanced through the fragmented mass.

Hot effluent gas from the combustion zone passes through the fragmented mass on the advancing side of the combustion zone to heat the oil shale in a retorting zone to a temperature sufficient to produce kerogen decomposition, called "retorting". Such decomposition in the oil shale produces liquid and gaseous products and a residual solid carbonaceous material in the retorted oil shale.

The liquid and gaseous products are cooled by the cooler oil shale fragments in the retort on the advancing side of the retorting zone. Shale oil, together with water produced or added to the retort collects at the bottom of the retort and is withdrawn. An off gas is also withdrawn from the bottom of the retort, including gaseous products of retorting, combustion products and any portion of the inlet mixture that does not take part in the combustion process.

A fragmented mass of particles can be formed in an in situ oil shale retort by excavating a void or voids within the retort site. Formation remaining within the retort site is then explosively expanded toward such voids for forming a fragmented permeable mass of formation particles. In effect, the volume of the voids excavated in the retort site is distributed between the particles of fragmented formation upon explosive expansion. The void fraction, typically expressed as a percentage, is the volume of the fragmented mass occupied by such void spaces between the particles. Thus, for example, in a fragmented mass having an average void fraction of 25%, the void spaces occupy 25% of the total volume of the fragmented mass and the particles occupy 75% of the total volume.

The arrangement of voids excavated in a retort site and techniques used for explosively expanding formation towards the voids can affect the uniformity of distribution of void fraction and hence permeability within the fragmented mass. It is desirable to have reasonably uniformly distributed void fraction in the fragmented mass for uniformity in permeability. This is desirable so that retorting gas can flow generally uniformly through the fragmented mass during retorting operations.

It is also desirable to have a reasonably high void fraction throughout the fragmented mass so that the total pressure drop due to gas flowing through the fragmented mass is not excessive. Gas may be passed through a retort for several months and an excessive pressure drop can result in considerable energy expenditure for causing the gas flow. Excessive pressure drop can also require use of gas blowers that are more costly than lower pressure fans.

It is therefore desirable that techniques used for forming an in situ oil shale retort provide means for controlling the void fraction distribution within the fragmented mass. Techniques in accordance with practice of this invention facilitate control over the void fraction distribution in a fragmented mass being formed.

SUMMARY OF THE INVENTION

There is, therefore, provided in practice of this invention according to a presently preferred embodiment a method for forming an in situ oil shale retort in a subterranean formation containing oil shale. Upper and lower voids are excavated in the retort site leaving an intermediate zone of unfragmented formation between the lower level void and the upper level void. In a preferred embodiment the volume of the lower level void is substantially larger than the volume of the upper level void. A lower portion of the intermediate zone is explosively expanded downwardly towards the lower level void which has sufficient volume to leave a void space between the top of the fragmented mass formed from the lower portion of the intermediate zone and the bottom of an upper portion of the intermediate zone. The volume of this void space is about the same as the available volume of the upper level void. The upper portion of the intermediate zone is then explosively expanded upwardly towards the upper level void and downwardly towards the void space for forming another portion of the fragmented mass of particles which substantially fills the in situ oil shale retort. Preferably the available volume of the lower level void and the upper level void collectively are sufficient for providing an average void fraction in the fragmented mass of up to about 25%. In an exemplary embodiment the lower portion of the intermediate zone has a height about one-half the narrowest width of a retort. Further, the portion of the fragmented mass expanded toward the lower void occupies about one-half of the height of the retort and the portion of the fragmented mass explosively expanded towards the void space and the upper level void occupies about the other half of the retort height. No substantial portion of the fragmented mass should have a void fraction less than about 20%.

DRAWINGS

These and other features and advantages of the invention will be appreciated as the same becomes better understood by reference to the following detailed description when considered in connection with the accompanying drawings wherein.

DESCRIPTION

Figure 1:
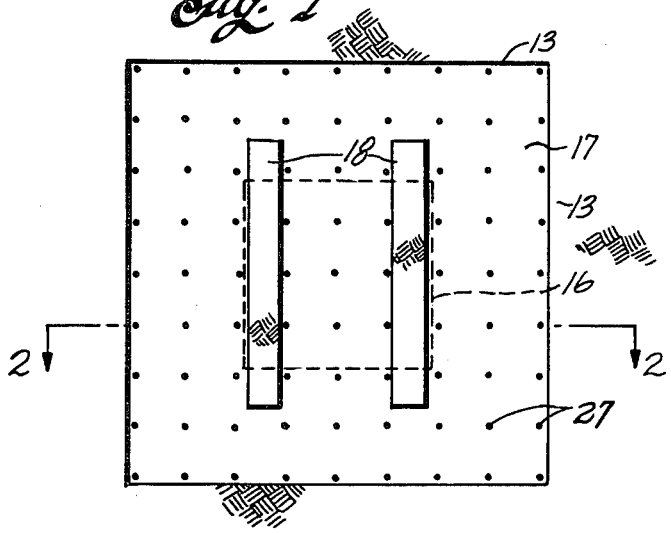
FIG. 1 is a semi-schematic horizontal cross section through the upper level of an in situ oil shale retort site in a preliminary stage of retort formation.

This specification has a generalized description of the technique for forming a retort by reference to the drawings, followed by an outline of the rationale and advantages of the technique, and concludes with a detailed description of an exemplary embodiment as illustrated in the drawings.

Figure 2:
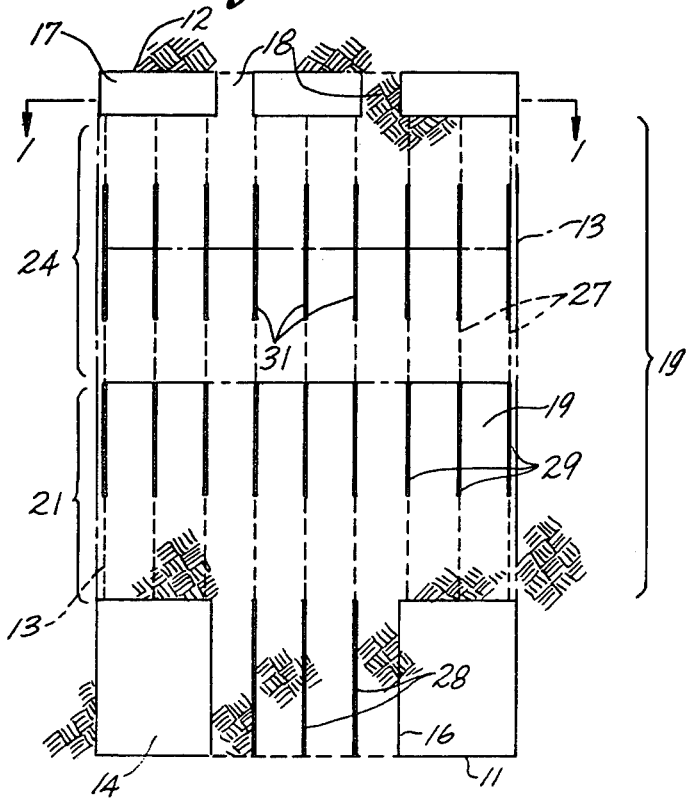
FIG. 2 is a semi-schematic vertical cross section of the retort at line 2—2 in FIG. 1.

FIGS. 1 and 2 illustrate in horizontal and vertical semi-schematic cross section an in situ oil shale retort at the stage of preparation when voids have been excavated in the retort site and explosive charges emplaced for explosively expanding formation towards those voids for making a fragmented mass of particles in the retort. The retort has a bottom boundary 11 of unfragmented formation, a top boundary 12 above the retort, and four vertically extending side boundaries 13. The specific embodiment illustrated happens to be square in horizontal cross section, however, the same principles are applicable for other horizontal cross sections such as rectangular.

A large volume lower level void 14 is excavated adjacent the bottom boundary 11 of the retort site. One or more pillars 16 of unfragmented formation can be left in the lower level void, if desired, for temporarily supporting overlying formation. A substantially smaller volume upper level void 17 is excavated adjacent the top boundary 12 of the retort site. One or more pillars 18 of unfragmented formation can be left in the upper level void, if desired, for temporary support of overlying formation. A zone 19 of unfragmented formation is left between the upper level void and lower level void.

Figure 3:
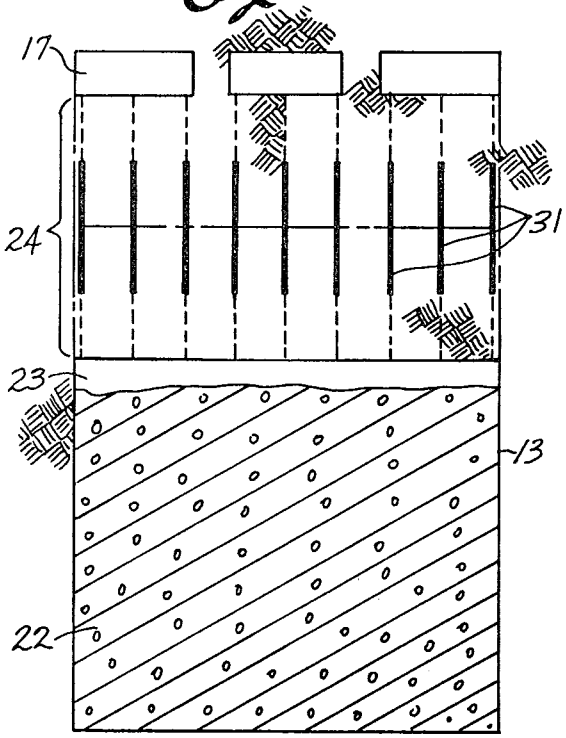
FIG. 3 is a semi-schematic vertical cross section of the retort at a later intermediate stage of formation.

The lower level pillar 16 and a lower portion 21 of the intermediate zone 19 are then explosively expanded towards the lower void 14 for forming a first fraction or moiety 22 (FIG. 3) of a fragmented permeable mass of formation particles in the in situ oil shale retort. This moiety 22 of the fragmented mass does not occupy all of the volume of the lower level void plus the volume of unfragmented formation explosively expanded. Thus, a void space 23 is left between the top of the lower moiety of the fragmented mass 22 and the bottom of an upper portion 24 of the intermediate zone 19. The relative volumes of the lower level void and formation explosively expanded towards that void are selected so that the volume of the void space 23 is about the same as the void volume of the upper level void 17 excluding pillars.

Figure 4:
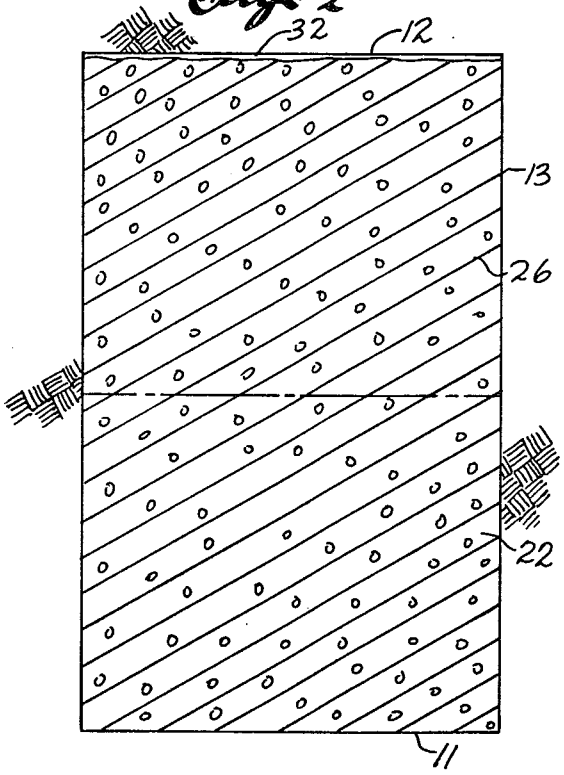
FIG. 4 is a semi-schematic vertical cross section of the retort containing a fragmented mass of particles.

The upper portion 24 of the intermediate zone is then explosively expanded both downwardly towards the underlying void space 23 and upwardly towards the upper level void 17. The pillars 18 in the upper level void are explosively expanded before the upper portion of the intermediate zone, preferably in the same round of explosions. This forms a second fraction or moiety 26 (FIG. 4) of the fragmented mass of particles in the retort on top of the first moiety 22 of the fragmented mass. The fragmented mass substantially fills the retort from the bottom boundary 11 to the top boundary 12. The two moieties of the fragmented mass may not be equal, but can occupy an arbitrary proportion of the retort height.

The average void fraction of the fragmented mass, that is the proportion of the volume occupied by void spaces, is determined by the volume of the voids excavated in the retort site and the volume of formation explosively expanded towards such voids. There are two conflicting considerations with respect to a desirable void fraction in the fragmented mass.

It is desirable to maintain a low average void fraction in an in situ oil shale retort since this reduces the mining costs by minimizing the volume of formation excavated for forming the voids. Further, the quantity of oil shale remaining in the retort for retorting can be maximized. It is considered desirable to have the average void fraction in the fragmented mass in a retort less than about 25%.

It is also desirable that the total pressure drop through an in situ oil shale retort be low. During retorting operations an upper portion of the fragmented mass is ignited and an oxygen supplying gas is introduced to sustain the combustion zone and cause it to advance downwardly through the fragmented mass. Off gas is withdrawn from the bottom of the retort. The combustion zone advances slowly through the fragmented mass and several months may be required for the combustion zone to advance through the full height of a retort.

The pressure differential between the top and bottom of the retort as gases flow therethrough should be minimized. This is desirable for minimizing the energy required for inducing gas flow through the retort. A relatively small increase in the pressure drop through the retort can involve substantial amounts of energy over the long time intervals required for retorting.

Further, it can be desirable to operate an in situ oil shale retort by withdrawing gas from the retort at a sufficient rate to maintain a pressure in the retort less than the pressure in adjacent underground workings. Such low pressure operation can result in substantial actual gas volumes and underground workings having a large cross section can be needed to minimize off gas velocity. By minimizing pressure drop through a retort, the decrease in pressure of the off gas can be minimized and actual gas flow rates in the off gas handling system also minimized. Additionally, when the pressure drop is low relatively lower cost fans can be used for gas handling than the higher cost blowers needed for a higher pressure drop.

The pressure drop of concern is the maximum pressure drop during retorting operations. The pressure drop during retorting when a portion of the fragmented mass is at elevated temperature can be significantly greater than before retorting operations when the fragmented mass is at about ambient temperature.

It is found that the unit pressure drop, that is, the pressure drop through a unit height of the retort, is sensitive to the void fraction in the fragmented mass of particles. The unit pressure drop is particularly significantly affected when the void fraction is low; that is, the unit pressure drop is not linearly related to the void fraction and the rate of change of unit pressure drop with change in void fraction is much larger at low void fractions than at higher void fractions. The very substantial effect of low void fraction on pressure drop can be appreciated when it is noted that pressure drop is proportional to $(1-VF)^2/VF^3$.

Because of the disproportionate influence of low void fraction on unit pressure drop, it is desirable that no significant portion of the fragmented mass in the retort have a void fraction less than about 20%. If a significant portion of the fragmented mass has a void fraction less than about 20% the total pressure drop through the retort can be excessive for economical operation.

Thus, it is desirable that the average void fraction in a fragmented mass of particles in a retort be up to about 25% and that no substantial portion of the fragmented mass has a void fraction of less than about 20%.

The void fraction in a fragmented mass is determined to a considerable extent by the volume of void space into which the formation is explosively expanded. In effect the void space from an excavated void is distributed between the particles in the fragmented mass. When formation is explosively expanded towards an unlimited void there can be substantial "bulking" so that the resultant fragmented mass occupies a considerably larger volume than the original unfragmented formation. An example of expansion towards an unlimited void would be explosive formation of a crater at the ground surface. Such "free bulking" of the formation can yield a maximum void fraction in the fragmented mass of particles.

When formation is explosively expanded towards less than an unlimited void its free expansion or bulking is constrained by the availability of void space. The average void fraction in the resulting fragmented mass cannot exceed the available void. Thus, for example, if 80 volumes of formation are explosively expanded toward 20 volumes of void space, the resulting fragmented mass cannot occupy more than 100 volumes. The average void fraction in the fragmented mass would be limited to 20%.

It has been found that the average void fraction in a fragmented mass explosively expanded towards a limited void can be less than the total available void. Constraints such as impact of particles on adjacent boundaries of unfragmented formation or on other particles can limit the freedom of expansion. The resulting fragmented mass may not fill the entire volume represented by the void space plus the volume occupied by the unfragmented formation. In such a situation the average void fraction in the fragmented mass is less than the total available void. For example, when formation is explosively expanded towards a horizontal free face adjacent a limited void having an available void space of about 33%, it is found that the average void fraction in a fragmented mass may be only about 27 to 28%. The actual average void fraction for a given available void can differ somewhat depending on geometry of the void space and parameters of the explosive expansion.

Thus, it appears that upon explosive expansion of formation towards a horizontally extending void that has an available void volume less than an unlimited void, the resulting fragmented mass has an average void fraction less than the available void space.

In a technique for forming an in situ oil shale retort wherein a zone of formation is undercut by a void and a zone of overlying formation is explosively expanded downwardly into the void in a plurality of layers or lifts, a non-uniform distribution of void fraction can result.

For example, it can be assumed that a 200 foot high retort is formed by excavating a 50 foot high void at the bottom. About 150 feet of overlying formation is to be explosively expanded towards the underlying void for an average void fraction of about 25%. It is assumed that this is expanded in two layers or lifts each 75 feet thick.

When the first layer is expanded towards the 50 foot high void, there is an available void of 40% $(50/75+50)$. Such a void can behave as less than an unlimited void and an actual average void fraction in the resulting fragmented mass can be as low as about 33%.

The expanded fragmented mass occupies more volume than the initial unfragmented formation. This increase in volume is known as bulking factor and is related to void fraction by the relation $BF=1/1-VF$, where BF is bulking factor and VF is void fraction. Thus, with a void fraction of 33%, the bulking factor is almost 1.5. The original 75 foot lift thus expands to a fragmented mass about 112 feet high. The void space between the top of this fragmented mass and the overlying 75 foot lift is thus only 13 feet high. The available void for the second lift is, therefore, only about 15%. If the actual void fraction in the fragmented mass formed from the lower lift is larger, the available void is even smaller.

The significant non-uniformity in void fraction in a fragmented mass formed in such an example cannot be readily alleviated by making the second lift considerably thinner than the first lift, since this makes it quite difficult to form an in situ retort of substantial height. It does not appear practical to form the fragmented mass with a very large first lift and considerably smaller second lift since the maximum height of a lift that can be expanded with short time delays appears to be about the same as one-half the narrowest width of the retort.

A technique as provided in practice of this invention helps alleviate the maldistribution of void fraction in an in situ oil shale retort of appreciable height. The result can be a retort containing a fragmented mass having an average void fraction less than about 25% with about half the height having an average void fraction of at least about 20% and the other half having an average void fraction that can be higher than 25%.

Such a technique is understood by reference to the accompanying drawings. In each of these semi-schematic views various access drifts for mining operations, retort ignition, introduction of combustion air, withdrawal of off gas and withdrawal of shale oil have been omitted since not required for an understanding of the technique for forming the retort. A numerical example is convenient for exposition and understanding of principles of this invention.

Thus, in an exemplary in situ oil shale retort the upper level void 17 and lower level void 14 are each about 165 feet square. These dimensions are suitable for forming a retort about 162 feet square. The additional width in the voids provides access for drilling equipment.

The upper level void 17 has a height of about 16 feet. The two rectangular pillars 18 each are about 16 feet wide and 105 feet long. This gives an extraction ratio in the upper level void of about 87.7%, leaving 12.3% of the initial volume of formation in the form of the pillars 18. This is equivalent in volume to an upper level void about 14 feet high extending over the entire horizontal cross section of the retort.

The lower level void 14 has a height of about 62 feet. A pillar 16 temporarily left in the lower level void is about 74 feet square for stability. This yields an extraction ratio of 80%, leaving 20% of the original unfragmented formation in the pillar 16. The lower level void is thus equivalent in volume to a void about 50 feet high extending over the entire horizontal cross section of the retort site.

In an exemplary embodiment the distance between the floor of the upper level void and the roof of the lower level void is about 190 feet. That is, the intermediate zone 19 of unfragmented formation between the upper and lower level voids is about 190 feet thick. This gives a total retort height of about 268 feet from the bottom boundary 11 to the top bounary 12 of the retort.

A plurality of vertical blast holes 27 are drilled downwardly from the upper level void towards the lower level void. The blast holes are illustrated by dashed lines in FIG. 2. In an exemplary embodiment the blast holes are in a square array with a spacing distance between the blast holes of about 20 feet. Thus, nine blast holes in each of nine rows covers the entire horizontal cross section of the retort. The pillars 18 in the upper level void are located so that the blast holes can be drilled in such a square array across the entire horizontal cross section of the retort from the upper level void.

The portion of the blast holes that overlie the pillar 16 in the lower level void are drilled downwardly through the entire immediate zone 19 and through the pillar in the lower level void to the bottom boundary of the retort. The balance of the blast holes that do not overlie the lower level pillar have their lower ends above the roof of the production level void. If desired, additional blast holes can be drilled from the upper level void downwardly into the lower level pillar for better distribution of explosive in the pillar. Alternatively, if desired, horizontal blast holes can be drilled in the lower level pillar for explosive expansion.

The fragmented mass in the retort is formed by explosive expansion of formation towards the voids in two stages which can be in a single round of explosions or in separate rounds.

The first stage is to explosively expand the pillar 16 in the lower level void and the lower portion 21 of the intermediate zone 19. Preferably the lower level pillar and lower portion of the intermediate zone are explosively expanded in a single round.

In an exemplary embodiment the lower portion 21 of the intermediate zone explosively expanded towards the lower level void is about 85 feet thick. The remaining upper portion 24 of the intermediate zone is thus about 105 feet thick.

A height of 85 feet for the lower portion of the intermediate zone is selected since it is about the same as one-half the width of the retort. It is believed that the maximum thickness of such a layer or lift explosively expanded towards a horizontal free face above an undercutting void should be about one-half the narrowest width of the retort for effective an reliable explosive expansion with reasonable quantities of explosive and short time delays (e.g. about one millisecond per foot of spacing between blast holes). With such a maximum thickness, void fraction within the resultant fragmented mass can be reasonably uniformly distributed. A thicker lift or layer can be more restrained by adjacent side walls of unfragmented formation and may yield less desirable fragmentation, explosive expansion, and void fraction distribution.

Explosive charges 28, indicated by heavy solid lines in FIG. 2, are placed in the portion of the blast holes 27 drilled through the lower level pillar. Such columnar explosive charges extend from the elevation of the floor to the elevation of the roof of the lower level void. The blast holes are stemmed with inert material above that elevation.

Columnar explosive charges 29 are loaded in the lower ends of the blast holes that end above the roof of the lower level void and in the corresponding length of the blast holes that also extend into the lower level pillar 16. This array of columnar explosive charges 29 is located in about the upper half of the lower portion 21 of the intermediate zone. Thus, the explosive charges extend from an elevation about 40 feet above the roof of the lower level void to an elevation about 85 feet above that roof. The blast holes are stemmed above that elevation. Placing the array of columnar explosive charges in the upper half of the lower portion of the intermediate zone provides effective fragmentation of the lower portion without excessive use of explosive.

These explosive charges 28 and 29 are detonated in a single round, commencing with the explosive charges 28 in the lower level pillar. This explosively expands the pillar and distributes its fragments across the lower level void. After a moderate time delay (for example, in the order of 200 milliseconds) explosive charges 29 in the lower portion of the intermediate zone are detonated. Additional short time delays between charges in this array can also be used for controlling explosive expansion of the lower portion of the intermediate zone toward the lower level void.

The available void for such explosive expansion is equivalent to a void fraction of about 33.7% in the fragmented mass resulting from explosive expansion of the pillar and lower portion of the intermediate zone. This is less than an unlimited void and the resulting fragmented mass occupies less than the entire volume available for explosive expansion. Based on test results it is estimated that the fragmented mass 22 (FIG. 3) formed by such explosive expansion has an average void fraction of about 27.8%. This lower moiety 22 of the fragmented mass in the retort has an average thickness of about 133 feet, leaving a void space 23 about 14 feet high between the top of the lower moiety of the fragmented mass and the bottom of the upper portion 24 of the intermediate zone. Thus, the volume of the void space 23 is about the same as the available volume of the upper level void 17.

In a second stage of explosive expansion for forming a fragmented mass in the retort, the upper level pillars 18 are explosively expanded towards the upper level void and the upper portion 24 of the intermediate zone is explosively expanded upwardly towards the upper level void and also downwardly towards the void space 23 overlying the lower moiety 22 of the fragmented mass in the retort.

An array of columnar explosive charges 31 is placed in the blast holes 27. These explosive charges are placed in about the middle half of the upper portion 24. The upper portion is about 105 feet thick and such columnar explosive charges can, for example, be about 55 feet in length. The lower end of such a charge is about 25 feet from the bottom of the upper portion of the intermediate zone and the upper end of such a charge is about 25 feet from the floor of the upper level void.

Explosive charges are also placed in horizontal blast holes (not shown) drilled in the upper level pillars 18. These explosive charges in the pillars are detonated first, followed by detonation of the explosive charges 31 in the upper portion of the intermediate zone. All of these charges are detonated in a single round with a time delay (for example, in the order of 200 milliseconds) between detonation of charges in the pillars and detonation of charges in the upper portion of the intermediate zone. Time delays (for example, in the order of 25 milliseconds) can also be used in the array of explosive charges in the upper portion of the intermediate zone.

By centering the columnar explosive charges in the middle half of the upper portion, that portion is about equally expanded upwardly and downwardly. Thus, about half of the upper portion is explosively expanded upwardly towards the upper level void and about half is explosively expanded downwardly towards the void space 23. Since the volume of the void space is about the same as the available volume of the upper level void, reasonably uniformly distributed void fraction is obtained in the resulting fragmented mass.

Such explosive expansion results in an upper moiety 26 (FIG. 4) of the fragmented mass in the retort occupying substantially all of the remaining 135 feet of the retort height. The upper moiety of the fragmented mass has an average void fraction of about 20.9%. The void fraction may be slightly less since the fragmented mass in the retort may not actually completely fill the retort cavity from the bottom boundary to the top boundary and a small void space 32 two or three feet high can exist between the top of the fragmented mass and the top boundary of unfragmented formation. If desired, formation overlying the upper level void can be explosively expanded for occupying any void space overlying the second or upper moiety 26 of the fragmented mass of particles in the retort.

If desired, the lower portion of the intermediate zone can be explosively expanded downwardly towards the underlying lower level void and thereafter the explosive charges 31 in the upper portion of the intermediate zone can be loaded. Thus, a substantial time interval can exist between the two stages of explosive expansion.

Alternatively, all of the explosive charges can be loaded in both the upper and lower portions and in the pillars, and both portions can be expanded in a single round of explosions. In such an embodiment a time delay is preferably provided between detonation of explosive charges in the lower portion and detonation of explosive charges in the upper portion of the intermediate zone. An exemplary time interval is in the order of 200 milliseconds between the last detonation in the lower portion of the intermediate zone and the first detonation in the upper portion. Explosive expansion of both portions of the intermediate zone in a single round is preferred to minimize sloughing of formation from the bottom of the upper portion into the void space overlying the lower moiety of the fragmented mass.

When the two portions of the intermediate zone are explosively expanded in a single round a separately identifiable void space may not be observed between the lower moiety of the fragmented mass and the bottom of the upper portion of the intermediate zone due to the short time intervals involved. Such a void space is, however, effectively present when a time delay is provided between detonation of explosives in the lower and upper portions of the intermediate zone. Formation from the lower portion commences expanding downwardly before explosive expansion of the upper portion commences and in effect the void space is occupied by expanding formation from the upper portion at about the same time the void space is created.

In the exemplary embodiment the average void fraction in the fragmented mass in the retort is about 24.4%. About the bottom half of the fragmented mass has an average void fraction of about 27.8%. About the upper half of the fragmented mass in the retort has an average void fraction of about 20.9%. Thus, the average void fraction of the entire fragmented mass is less than about 25% and each moiety of the fragmented mass has an average void fraction more than about 20%.

With an explosive expansion technique producing a fragmented mass having such a void fraction distribution, the estimated maximum pressure drop through the fragmented mass in the retort during retorting is about 39 inches of water at a flow rate of 0.62 SCFM per square foot of retort cross section.

This can be compared with the pressure drop through a fragmented mass formed using a different blasting scheme and having the same average void fraction with a less desirable void fraction distribution. In such an embodiment an intermediate zone is explosively expanded upwardly and downwardly. A lower one-third of the zone is expanded downwardly towards a lower level void. The upper two-thirds of the zone is then explosively expanded downwardly towards void space overlying the lower portion of the fragmented mass and upwardly towards an overlying void. The resulting fragmented mass has a lower moiety about 108 feet high with an average void fraction of about 30.5% and an upper moiety about 160 feet high with an average void fraction of about 20%. The maximum pressure drop through such a fragmented mass during retorting is estimated at about 50 inches of water at a flow rate of about 0.62 SCFM per square foot of retort cross section.

The least possible maximum pressure drop during retorting that can be obtained with the average void fraction of the exemplary embodiment is about 32 inches of water if the void fraction were completely uniformly distributed throughout the fragmented mass.

In the example given above of a retort with an average void fraction of about 25%, a lower moiety of about 56% of the retort height having an average void fraction of about 33%, and an upper moiety of about 44% of the retort height having an average void fraction of about 15%, the estimated maximum pressure drop during retorting would be in excess of 80 inches of water.

By assuring that no substantial portion of the fragmented mass in the retort has a void fraction of less than about 20%, a reasonable pressure drop can be obtained through an in situ oil shale retort.

The void volume of the lower level void should be substantially greater than the void volume of the upper level void to make available sufficient void space for explosive expansion of the lower portion of the intermediate zone downwardly toward the lower level void as well as explosive expansion of the upper portion of the intermediate zone both upwardly and downwardly. The available void volume of the lower level void should be at least about twice the void volume of the upper level void. If the void volume of the lower level void is less than about twice the void volume of the upper level void the total retort height can be unduly limited due to the proportions used to avoid a substantial portion of the fragmented mass with an average void fraction less than about 25%. Preferably the lower level void has a void volume greater than about three times the available void volume of the upper level void. When the void volume of the lower level void is more than about three times the void volume of the upper level void the height of the lower portion of the intermediate zone can be about the same as one-half the width of the retort and the upper portion can have a substantial height for forming a retort containing a fragmented mass of substantial height.

Although the technique for forming an in situ oil shale retort has been described by reference to a specific embodiment many modifications and variations will be apparent to one skilled in the art. Thus, for example, the same principles are applicable for forming a fragmented permeable mass of particles in an underground cavity for other in situ mineral recovery processes and references to an in situ oil shale retort is a convenient label for such an in situ recovery zone. It is therefore to be understood that within the scope of the following claims the operative steps can be practiced otherwise than as specifically described.

What is claimed is:

1. An in situ oil shale retort in a subterranean formation containing oil shale, the retort having a top boundary, bottom boundary, and vertically extending side boundaries of unfragmented formation and containing a fragmented permeable mass of formation particles containing oil shale having an average void fraction up to 25%, the lower half of the fragmented mass having an average void fraction greater than 25% and the upper half of the fragmented mass having an average void fraction of at least 20% but less than 25% thereby resulting in the lower half of the fragmented mass having a higher average permeability than the average permeability of the upper half of the fragmented mass.

2. An in situ oil shale retort as claimed in claim 1 wherein the upper and lower halves of the fragmented mass each occupy about one-half of the height of the retort between the bottom boundary and the top boundary.

3. An in situ oil shale retort as claimed in claim 1 wherein the upper and lower halves of the fragmented mass collectively substantially fill the retort between the bottom boundary and the top boundary.

4. An in situ oil shale retort as claimed in claim 1 wherein no substantial portion of the fragmented mass has a void fraction of less than about 20%.

* * * * *